United States Patent [19]

Watson

[11] 4,401,859

[45] Aug. 30, 1983

[54] DIRECTIONAL MICROPHONE WITH HIGH FREQUENCY SELECTIVE ACOUSTIC LENS

[75] Inventor: Alan R. Watson, Niles, Mich.

[73] Assignee: Electro-Voice, Incorporated, Buchanan, Mich.

[21] Appl. No.: 268,376

[22] Filed: May 29, 1981

[51] Int. Cl.[3] ..... H04R 1/32

[52] U.S. Cl. ..... 179/121 D; 181/176; 181/158; 179/138

[58] Field of Search ..... 179/115 R, 115.5 R, 179/121 D, 138; 181/160, 158, 176

[56] References Cited

U.S. PATENT DOCUMENTS 3,201,516 8/1965 Weingartner ..... 179/121 D 3,573,400 4/1971 Sessler ..... 179/121 D 3,908,095 10/1975 Jinsenji ..... 181/176

*Primary Examiner*—G. Z. Rubinson

*Assistant Examiner*—L. C. Schroeder

*Attorney, Agent, or Firm*—Burmeister, York, Palmatier, Hamby & Jones

[57] ABSTRACT

A unidirectional dynamic microphone provided with a first sound path to the forward side of the diaphragm and a second sound path to the rear side of the diaphragm, a Helmholtz resonator disposed in the first sound path having a sound entrance, and a diffraction lens mounted ahead of the Helmholtz resonator and partially shadowing the sound entrance to the Helmholtz resonator for the purpose of increasing the high frequency response of the microphone.

7 Claims, 5 Drawing Figures

DIRECTIONAL MICROPHONE WITH HIGH FREQUENCY SELECTIVE ACOUSTIC LENS

The present invention relates generally to microphones and particularly to directional microphones.

For many sound applications, it is desirable to use a directional microphone. This is particularly true for a vocalist employing a sound enhancing public address system. A directional microphone is nonresponsive to sounds emanating from the back of the microphone, and hence a vocalist facing the audience will automatically be using the microphone in a position to minimize feedback from the loudspeakers of the public address system. As an additional precaution against feedback, vocalists generally employ a microphone close to the mouth, thereby permitting the sound system to be operated at low microphone gain. However, the frequency response of a microphone is different when used close to the mouth of a vocalist than it is for remote use, in that the base response is significantly increased due to such proximate use of directional microphones.

In order to overcome the accentuated bass response of a microphone used by a vocalist in close proximity to the microphone, it is desirable to accentuate the high frequency response in order to provide adequate brightness to the performance. There are two conventional techniques for increasing the brightness of a microphone, namely, the use of a Helmholtz resonator near the high frequency end of the response range of the microphone, and the use of a diaphragm system with a very high mechanical resonance. The Helmholtz resonator itself is generally not sufficiently effective to provide the degree of brightness desired, and it is necessary to use expensive techniques in conventional microphones to provide an adequately high diaphragm resonance, such as utilizing a very lightweight voice coil made of aluminum, or the like, and a very compliant diaphragm surround. In most cases, adequate stiffness of the diaphragm cannot be achieved with a very compliant surround without the use of a costly laminated diaphragm. It is one of the objects of the present invention to provide a directional microphone with a frequency response characteristic suitable for a closely held microphone with an improved high frequency response. Further, it is an object of the present invention to provide such a microphone economically, in that it may be constructed without the use of an expensive lightweight voice coil or a laminated diaphragm.

In both directional and nondirectional microphones equipped with pop filters, it is generally necessary to accentuate the high frequency response of the microphone. Pop filters generally consist of a layer of open cellular foam material placed ahead of the diaphragm, and such material discriminates against high frequency sound. Accordingly, such microphones tend to be dull, unless the high frequency response of the microphone itself is accentuated. It is a further object of the present invention to provide a microphone with a pop filter in which a novel construction provides the microphone itself with an accentuated high frequency response.

There is a constant quest for a more directional microphone, particularly a more directional microphone which may be constructed in a small configuration. It is a further object of the present invention to increase the directivity of a directional microphone having a generally cardioid response pattern.

The present invention utilizes the combination of an electroacoustical transducer with a diaphragm, a shell with an aperture confronting the diaphragm, and an acoustic lens in the form of a diffraction plate mounted on the shell on the opposite side of the diaphragm and partially shadowing the aperture. This structure discriminates against sounds in the lower frequency portion of the response range of the microphone.

Acoustic lenses are well known in the prior art. Harry F. Olson in *Acoustical Engineering,* D. Van Nostrand Company, Inc., 1957, has described the use of metal sheets in an acoustical lens and also at page 321 describes the combination of such an acoustical lens with a microphone for the purpose of providing a directional microphone, and for the purpose of focusing incident sound upon the microphone. The microphone constructed according to the present invention, however, utilizes the diffraction achieved by a plate of proper cross section to bend the incident sound waves proportional to the frequency of the sound wave, and thereafter utilizes a restricting aperture to exclude a portion of the immediately lower frequencies of the refracted sound waves from access to the diaphragm, thereby providing a sound field at the diaphragm with a ratio of high frequency content to immediately lower frequency content greater than the incident sound field. Since sound waves at the lower portion of the audible range are not substantially affected by the presence of a plate with a cross section small compared to the wavelength, such low frequency waves impinge upon the diaphragm restricted only by the area of the aperture. In a preferred construction, the restricting aperture is disposed in the wall of a shell which encloses the forward side of the diaphragm and forms a Helmholtz resonator, and the aperture is in the form of a plurality of holes located in the wall of the shell in a circular configuration concentric with a sound diffracting disc. An open cellular foam layer is disposed ahead of the lens to provide a pop filter.

For a more complete description of the present invention and a preferred embodiment of the present invention, reference is made to the drawings, in which.

Figure 1:
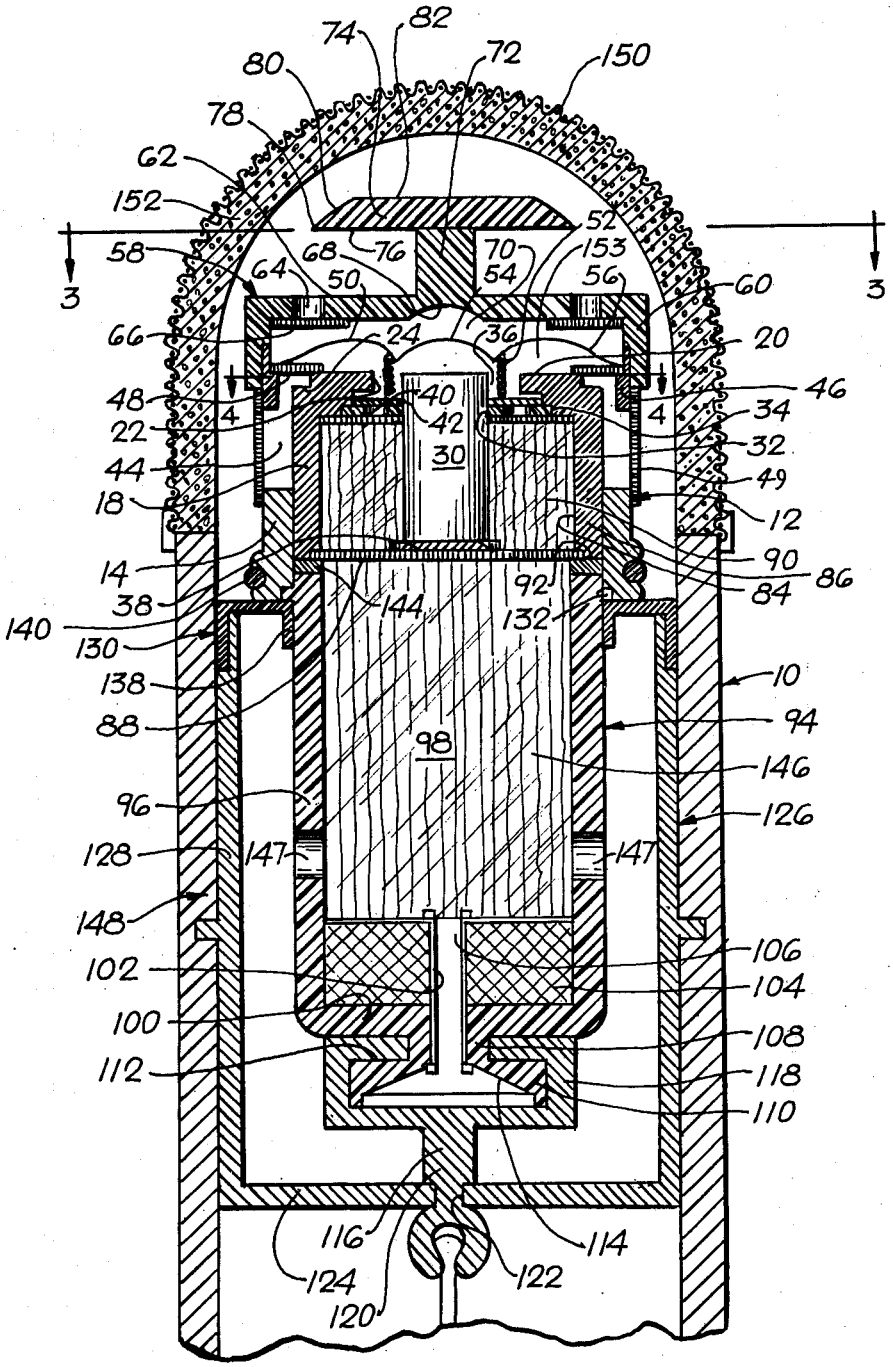
FIG. 1 is a longitudinal central sectional view of a microphone constructed according to the present invention, the plane of the figure being shown in FIG. 5, and the figure being broken away to omit conventional elements forming no part of the present invention.
Figure 2:
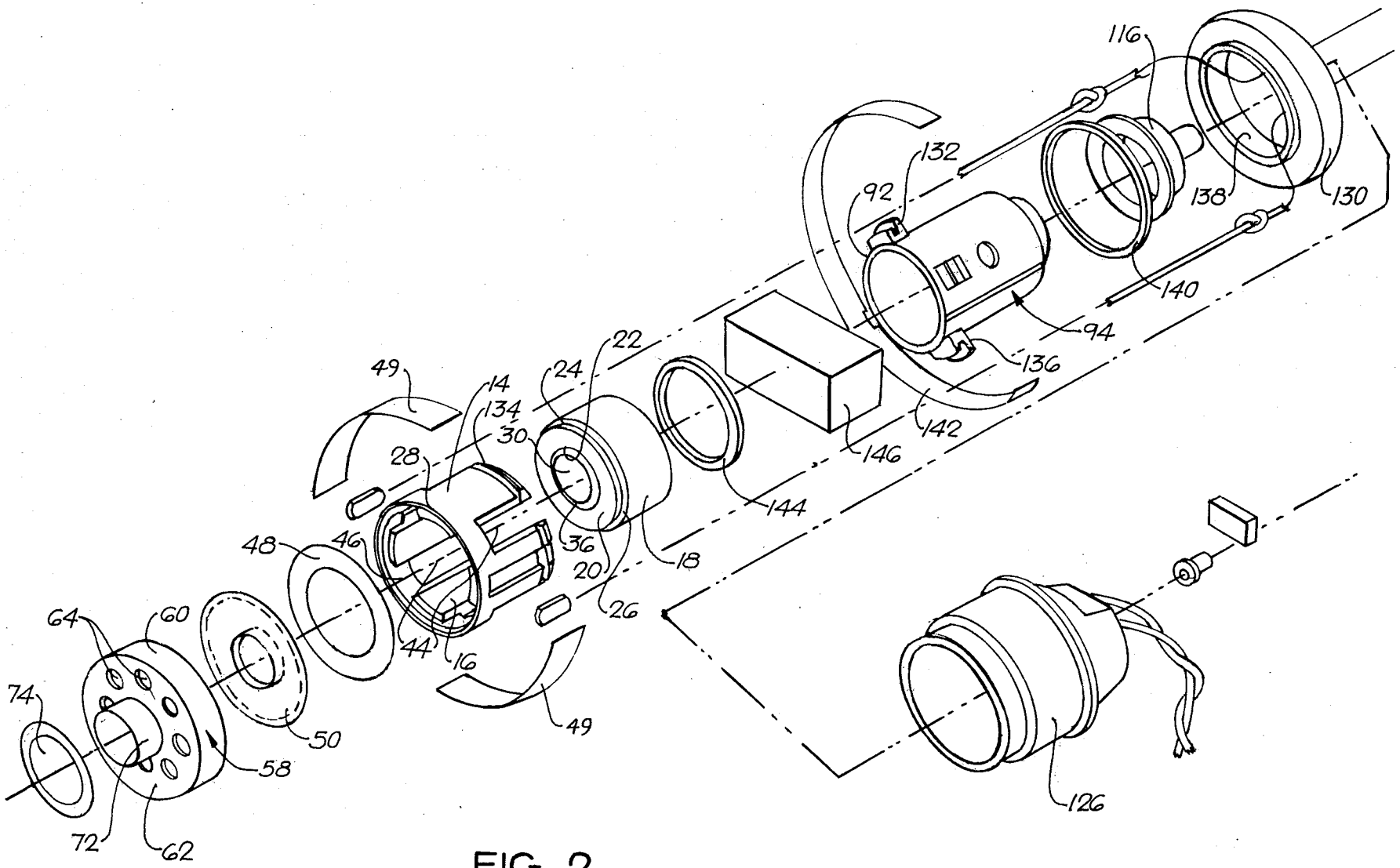
FIG. 2 is an exploded view of the elements of the acoustical transducer illustrated in FIG. 1.
Figure 3:
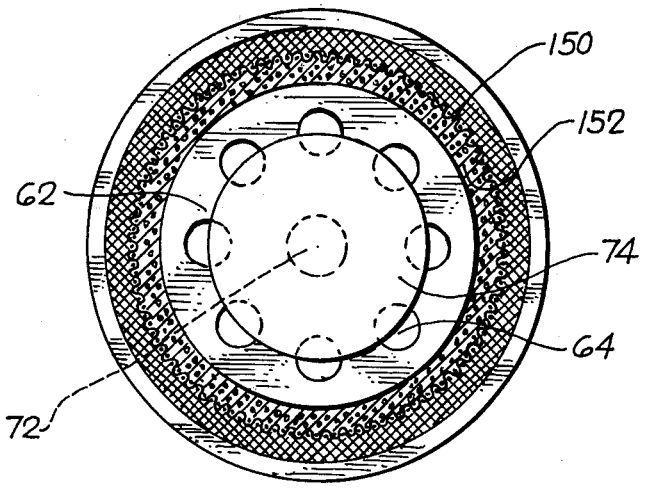
FIG. 3 is a sectional view taken along the line 3—3 of FIG. 1.
Figure 4:
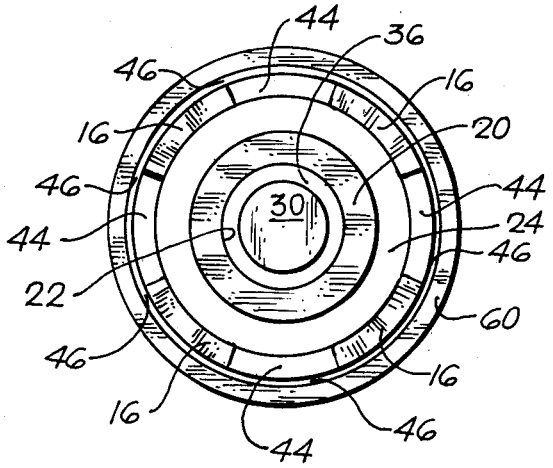
FIG. 4 is a sectional view taken along the line 4—4 of FIG. 1.

As illustrated in FIG. 1, the microphone has a casing 10 which encompasses and houses a transducer structure 12. The transducer structure 12 has a hollow cylindrical shell 14 which has a plurality of spaced ribs 16 aligned with the axis of the shell and distributed about the inner surface thereof. A cylindrical ferromagnetic pot 18 is disposed within the shell 14 and maintained in fixed position in abutment with the ribs 16, the cylindrical pot being coaxial with the shell. The pot has a forward wall 20 which is provided with a cylindrical aperture 22 which is disposed coaxially with the cylindrical wall of the pot 18. The wall 20 is also provided with a recess 24 which extends about the perimeter of the wall forming a circular surface 26 disposed in a plane parallel to the wall 20 and recessed therefrom. The ribs 16 of the shell 14 terminate at a distance from the end 28 of the shell, and the pot 18 is disposed within the shell with the surface 26 aligned with the ends of the ribs 16.

A cylindrical magnet 30 is mounted within the shell 18 and has an end disposed coaxially within the cylindrical aperture 22. The magnet 30 extends through a coaxial opening 32 in a circular disc 34 which engages the inner surface of the pot 18 at its perimeter, thereby maintaining the magnet in proper position within the cylindrical aperture 22 and maintaining a circular gap 36 between the exterior surface of the magnet 30 and the cylindrical aperture 22. The end of the magnet 30 opposite the gap is mounted on a flat elongated end plate 38 which extends across the end of the pot 18 and engages the pot to form a magnetic circuit including the pot, gap and magnet. The disc 34 is provided with a plurality of spaced apertures 40 which extend at spaced intervals about the magnet 30, and a flat washer 42 of damping material, such as cloth, is secured on the surface of the disc 34 confronting the gap 36 to provide acoustical damping for the apertures 40.

The shell 14 is provided with openings 44 disposed between the ribs thereof, and these openings 44 extend to a rim 46 at the end 28 of the shell providing a slot for communication from the openings 44 to the recess 24 of the pot 18. A circular flat washer 48 of acoustically damping material, such as cloth, is mounted on the wall 20 of the pot 18 and extends across and is acoustically sealed on the rim 46 at the end 28 of the shell 14. Also, a strip 49 of acoustically damping material, such as cloth, extends over each of the openings 44 in the shell 14 to provide acoustical damping for the path formed between the openings 44 and the opening between the rim 46 and the recess 24.

A diaphragm 50 is mounted at its circular perimeter on the rim 46 of the shell 14 and is disposed coaxially about the end of the magnet 30. The diaphragm is spaced from the wall 20 of the pot 18, thus forming a diaphragm chamber. The diaphragm 50 carries a cylindrical coil 52 which is translatably disposed within the gap 36. The diaphragm 50 has a central dome 54 coaxially disposed within the cylindrical coil 52, and is provided with flutes 56 between the dome 54 and the perimeter of the diaphragm to maintain the diaphragm spaced from the wall 20 of the pot 18.

The diaphragm 50 is enclosed within a cap 58 which has a cylindrical wall 60 mounted outwardly on the rim 46 of the shell 14 and extending to the side of the diaphragm 50 opposite the wall 20 of the pot 18. The cap 58 is also provided with a disc 62 which extends across the end of the cylindrical wall 60 opposite the rim 46 to confront the diaphragm 50, and the disc 62 is provided with a plurality of spaced apertures 64 disposed in a circular configuration having their centers spaced by approximately equal distance in a circle coaxial with the magnet 30. A washer 66 is acoustically sealed over each of the apertures 64 on the surface of the disc 62 confronting the diaphragm 50, the washer 66 being of acoustically damping material, such as cloth. Also, the surface of the disc 62 confronting the diaphragm 50 is provided with a part spherical recess 68 confronting the dome 54 of the diaphragm, to provide a chamber 70 between the diaphragm and the cap 58 to form a Helmholtz resonator.

A post 72 extends outwardly from the surface of the disc 62 opposite the chamber 70 in alignment with the axis of the magnet 30, and a diffraction disc 74 is mounted on the end of the post 72 opposite the disc 62. The diffraction disc 74 has a flat surface 76 confronting the central portion of the disc 62 of the cap 58, and the perimeter of the surface 76 is coaxial with the circle formed by the centers of the apertures 64 in the disc 60 and of approximately the same diameter. Hence, the circular edge, designated 78, of the diffraction disc 74 confronts approximately the center of each of the apertures 64 in the disc 62 of the cap 58. From the circular edge 78 of the flat surface 76, the diffraction disc 74 is provided with a small contoured surface resembling a portion of the dome designated 80, and the dome portion 80 extends to a flat top surface 82 with a circular perimeter.

The pot 18 has a cylindrical inner surface 84, and the end of the pot opposite the wall 20 is a flat circular wall 86. A disc 88 of acoustical damping material, such as cloth, extends across the wall 86 and is sealed on the wall 86. The region bounded by the damping disc 88, the perforated disc 34, the magnet, and the inner surface 86 of the pot 18 is substantially filled with a mass 90 of acoustical damping material, such as fiberglass.

The circular wall 86 of the pot 18 is aligned with and abuts the circular end wall 92 of a rear chamber member 94. The chamber member 94 has a cylindrical body 96 forming a hollow cylindrical inner chamber 98, and the body 96 extends from the pot 18 to a flat end wall 100. The end wall 100 is provided with a central aperture 102 and accommodates an apertured disc 104 disposed in abutment therewith, the aperture 106 of the disc being aligned with the aperture 102. The end wall 100 is also provided with an outwardly extending sleeve 108, and a circular button 110 is disposed at the end of the sleeve opposite the end wall 100, the button having a flat surface 112 confronting the end wall 100 and an inwardly tapering surface 114 opposite the surface 112. A compliant boot 116 has a lip 118 which encompasses the button 110 and extends between the end wall 100 of the chamber member 94 and the surface 112 of the button to secure the chamber on the boot 116. The boot 116 has a post 120 which extends in alignment with the axis of the aperture 102 and is anchored in an opening 122 at the center of a circular end 124 of a cup 126. The cup 126 has a cylindrical portion 128 of greater diameter than the body 96 of the chamber member 94, and the cylindrical wall 128 extends about and is spaced from the body 96. The end of the cylindrical wall 128 opposite the end wall 124 engages a ring 130 of compliant material, and the ring 130 is anchored on the chamber member 94 and the shell 14, as hereinafter described.

The chamber member 94 is provided with a plurality of outwardly extending protrusions 132, and each of these protrusions is disposed within an opening 44 of the shell 14. The shell 14 is also provided with an outwardly extending ridge 134, and the ridge 134 is aligned with an outwardly extending ridge 136 on the ends of the protrusions opposite the body 96 of the chamber member 94, thereby providing a substantially continuous circular protrusion about the end of the shell 14 opposite the rim 46. The ring 130 of compliant material carries a cylindrical wall 138 at its inner edge, and the wall 138 is disposed about the external surface of the body 96 of the chamber member 94 is abutment with the protrusions 132. Hence, the chamber member 94 is secured between the ring 130 and the boot 116.

The shell 14 is mounted on the chamber member 94 by means of a retaining ring 140 engaged within the ridges 136 of the protrusions 132 and in abutment with the ridge 134 of the shell 14. A strip of tape 142 is disposed over the seam between the shell 14 and the chamber member 94, and a washer 144 is disposed between the pot 18 and the chamber member 94 to provide acoustical sealing between these elements. The chamber 98 is substantially filled with a mass of acoustical damping material 146, such as fiberglass, and the chamber 98 is in communication with the interior of the cup 126 through openings 147, to provide shock compensation in accordance with the teachings of the inventor's U.S. Pat. No. 3,766,333.

The microphone is provided with a casing 148 which has a cylindrical inner cavity disposed about and engaging the outer surface of the cup 126 to mount the microphone within the casing. The casing extends toward the diaphragm assembly from the compliant ring 130 to approximately the plane of the openings 44, and a spherical screen 150 extends from the casing 148 and encloses the elements of the microphone. A layer 152 of open cellular foam material is disposed on the inner side of the screen 150 to provide a windscreen. The layer 152 functions to attenuate sound bursts, thus preventing the microphone from responding with a sharp electrical pulse which reproduces as a sound "pop".

The microphone set forth in the figures is a single-D uni-directional microphone. Sound is permitted to pass through the screen 150, the layer of open cellular foam material 152, the apertures 64 and impinge upon the forward side of the diaphragm 50. In like manner, the sound field is permitted to pass through the screen 150, the layer 152 of foam material, the openings 44 in the shell 14, between the ribs 16 of the shell past the rim 46, and through the damping washer 48 into the region between the wall 20 and the diaphragm 50, this region being referred to as the diaphragm chamber and designated 153. At higher frequencies, the sound field from the rear of the microphone and along the central axis of the microphone enters the diaphragm chamber 102 out of phase with the sound entering the forward chamber 70 through the screen 150 and impinging upon the forward side of the diaphragm 50, so that such sound waves cancel, thus producing a cardioid pattern at that frequency. At lower frequencies, sounds entering the diaphragm chamber 153 from the rear side of the microphone and along the axis of the microphone will add vectorially to sound waves entering the diaphragm chamber 153 through the voice coil gap 36 and tend to cancel the sound waves in the forward chamber 70.

Figure 5:
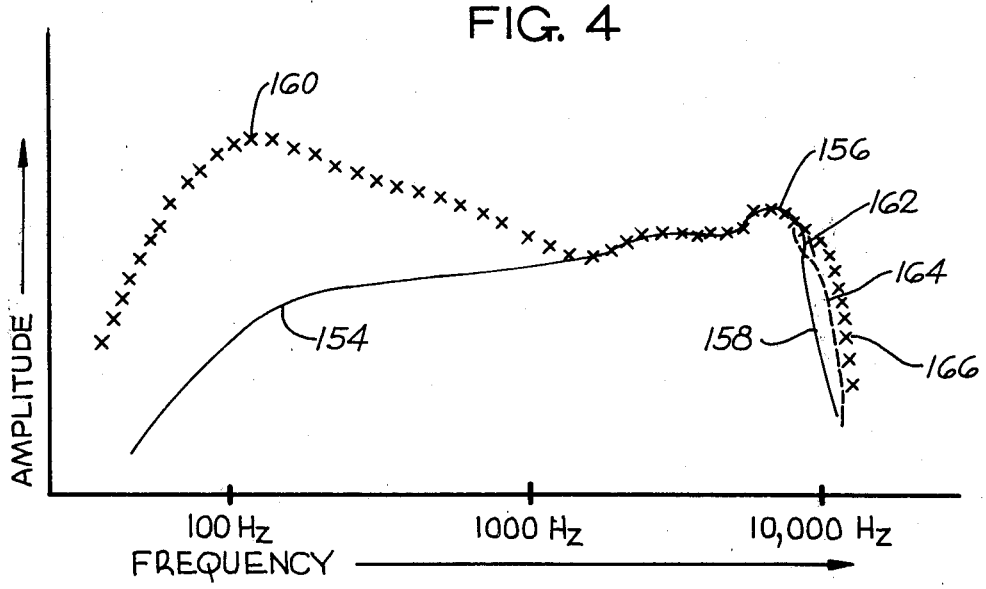
FIG. 5 is a graph illustrating the relationship between frequency and amplitude of electrical output of the microphone of FIGS. 1 through 4 under different conditions.

In FIG. 5, the solid line designated 154 illustrates the frequency response curve in response to sound waves from a distant source of a microphone constructed in the manner of FIGS. 1 through 4, excepting the post 72 and diffraction disc 74 have been omitted from the microphone. It will be noted that the solid curve 154 rises as the frequency rises to a peak 156, and then falls abruptly as illustrated by the portion of the curve 158. When the microphone is held close to the mouth of the user, however, a proximity effect occurs and enhances the bass response, as illustrated by the X-formed line designated 160. This proximity effect may thus be employed for a microphone held close to the mouth of the user to achieve a frequency response pattern which is much closer to a flat pattern than the microphone achieves in response to a distant source. The peak 156 is achieved by use of the Helmholtz resonator formed by the cap 58 and diaphragm 50.

While the Helmholtz resonator will extend the frequency response of the microphone upwardly, it is limited by a high frequency cutoff, illustrated at 162. The inventor has found that the high frequency response of the microphone may be extended to frequencies higher than can be achieved by use of the Helmholtz resonator alone by positioning the diffraction disc 74 ahead of the Helmholtz resonator, and the dashed line curve 164 of FIG. 5 illustrates the high frequency enhancement achieved by this construction for sound waves remote from the microphone diaphragm. A still greater enhancement to the high frequency response is achieved by this construction for a microphone held close to the sound source, as indicated by the X-shaped curve 166 above the frequency 162.

The Helmholtz resonator is conventionally tuned to a frequency near the upper limit of the response range of the microphone in order to maximize the extension of the high end of the frequency response, but the use of the diffraction disc 74 permits tuning the Helmholtz resonator to a lower frequency to increase the energy in the portion of the response range between the effective region of the diffraction disc and the frequency of the Helmholtz resonator. In one particular construction of a microphone according to FIGS. 1 through 4, the Helmholz resonator is designed to achieve resonance at a frequency of approximately 9,000 Hz. As indicated by the dashed and crossed lines of FIG. 5, the use of the diffraction disc 74 extends the frequency response upwardly from the upper limit of the region of the response range controlled by the Helmholtz resonator to approximately 14,000 Hz. The use of the disc 74 increases the energy above 10,000 Hz., thus permitting the Helmholtz resonator frequency to be lowered below 10,000 Hz. and increasing the energy between 6,000 Hz. and 10,000 Hz.

The diffraction disc 74 functions as an acoustic lens. Sound waves traveling toward the forward side of the diaphragm on the axis of the microphone will be bent inwardly to a focal point, and the focal point must be on the side of the disc 62 of the diaphragm chamber 153. The diffraction effect does not occur at low frequencies, and is effective only for frequencies above approximately 5,000 Hz. Further, the higher the frequency, the more pronounced the diffraction effect. The diffraction disc 74 therefore has the effect of bending waves impinging upon the microphone from the forward side of the diaphragm on the axis of the microphone toward the axis of the microphone for frequencies near the upper end of the response range of the microphone. It will be noted that the diffraction disc 74 approximately shadows one-half of each of the apertures 64, thereby shadowing the apertures for frequencies too low to achieve significant bending, that is, frequencies below approximately 5,000 Hz. Hence, the window afforded by the apertures 64 for frequencies below approximately 5,000 Hz. is only approximately half as large as the window for frequencies bent by the diffraction disc 74, and a disproportionate large portion of the higher frequencies enter the Helmholtz resonator as a result of the diffraction disc 74. To achieve this effect, the cross section of the apertures 64 must be sufficiently small to require diffraction of high frequencies for entering into the chamber 70, and the inventor has found that the apertures 64 must have a cross section no greater than one-fourth wavelength at the upper limit frequency. Lower frequencies are not affected to a substantial degree by an obstruction such as the diffraction disc 74, and the lower frequencies will enter through the apertures 64 unimpeded by the disc 74. Hence, peak 160 achieved by proximate use of the microphone at low frequencies will not be disturbed by the presence of the diffraction disc 74, but the extended high frequency response of the curve 166 will be achieved.

The diffraction disc 74 will only function to bend sound waves toward the axis if it has a cross sectional diameter between 0.3 wavelengths and 1.5 wavelengths for the incident sound waves. Accordingly, the diameter of the diffraction disc 74 should be between 0.3 and 1.5 wavelengths of sound waves at the upper limit of the frequency response range of the microphone. In one particular construction of a microphone as shown in FIGS. 1 through 4, the diffraction disc 74 has a diameter of 0.7 inches, and is centered about apertures 64 centered at a diameter of 0.7 inches. The apertures 64 in this construction have a diameter of 0.14 inch, and there are a total of eight apertures 64 equally spaced about the center of the disc 74.

The post 72 serves to space the flat surface 76 of the diffraction disc 74 from the apertures 64, and the flat surface 76 should be spaced sufficiently to permit those forward on-axis sound waves having a frequency at the upper end of the response range of the microphone which are disposed at the edge 78 of the diffraction disc 74 to be refracted toward the center of the disc 74 and pass through the apertures 64 at the side adjacent to the post 72. The focal length of the acoustic lens formed by the diffraction disc 74 need not be in the Helmholtz resonator, but the sound waves at the upper end of the frequency range must enter the Helmholtz resonator to permit the microphone to respond. In a particular construction of the present invention, the post 72 is 0.2 inches in length.

The benefits of the present invention may be achieved without the use of the Helmholtz resonator, that is, it is not necessary that the chamber 70 form a resonant structure near the upper end of the microphone response range. There are however advantages to utilizing the Helmholtz resonator at the upper end of the response range of the microphone to increase high frequency response in combination with a diffraction disc to extend the high frequency response range above the range effectively extended by the Helmholtz resonator.

Further, the present invention may be utilized with microphones other than directional microphones, but the diffraction disc itself achieves a high frequency directionality to the microphone, since it will not focus off axis sound into the chamber 70. The use of a diffraction lens on a single-D directional microphone is particularly advantageous in view of the fact that such microphones exhibit an accentuated output at low frequencies when used proximate the user's mouth, thereby requiring high frequency accentuation.

Those skilled in the art will readily devise additional applications and uses for the present invention. It is therefore intended that the scope of the present invention be not limited by the foregoing specification, but rather only by the appended claims.

The invention claimed is:

1. A microphone having a frequency response range extending to an upper limit frequency comprising, in combination: an electroacoustical transducer having a hollow casing with an opening to the exterior thereof, a diaphragm disposed in a plane and acoustically sealed across the opening to receive sound waves from exterior of the casing, said transducer producing an electrical output responsive to deflection of the diaphragm; a shell mounted on the casing confronting the diaphragm, said shell having a wall spaced from and confronting the diaphragm provided with an aperture therein, the aperture having a cross section no greater than one-fourth wavelength, and a diffraction plate mounted on the shell forming an acoustic lens with a focal point for upper limit frequencies on the side of the wall of the shell opposite the lens, said plate having a cross sectional dimension between 0.3 wavelengths and 1.5 wavelengths at said upper limit frequency, said plate being spaced from the wall of the shell by a distance less than the focal length of the lens at said upper limit frequency, and the aperture in the wall of the shell being disposed on an axis between the edge of the plate and the focal point of the acoustic lens at said upper limit frequency, said aperture being partially shadowed by the plate for incident sound waves traveling on an axis normal to the plane of the diaphragm.

2. A microphone comprising the combination of claim 1 wherein the surface of the wall of the shell which confronts the lens is substantially flat and the lens comprises a disc having a flat surface disposed parallel to and confronting the flat surface of the wall, the wall being provided with a plurality of apertures for admitting sound into the cavity disposed in a circular configuration concentric with the disc, each of said apertures being disposed in a plane perpendicular to the flat surface of the disc on an axis in said plane between the focal point of the lens and the edge of the disc.

3. A microphone comprising the combination of claim 2 wherein the diameter of the disc is approximately one-half wavelength at the upper limit frequency of the microphone.

4. A microphone comprising the combination of claim 2 wherein the disc is thickest at the center and the surface of the disc opposite the flat surface is a continuous surface of revolution extending from a circular line approximately in the plane of the flat surface of the disc to the central axis of the disc.

5. A microphone comprising the combination of claim 2 wherein the disc has a diameter of approximately 0.7 inches and is spaced from the wall by approximately 0.2 inches, and the aperture has a diameter of approximately 0.14 inches.

6. A microphone comprising the combination of claim 5 wherein eight apertures are disposed in the wall at equal spacing confronting the disc, each aperture having a center spaced from the central axis of the disc by approximately the radius of the disc.

7. A microphone comprising the combination of claim 1 wherein the shell is acoustically sealed about the opening in the casing, and the shell and diaphragm form a resonator cavity at a frequency in the upper half of the frequency response range of the microphone.

* * * * *